US012031329B2

(12) United States Patent
Argyrou

(10) Patent No.: US 12,031,329 B2
(45) Date of Patent: Jul. 9, 2024

(54) PRECAST BUILDING PANEL

(71) Applicant: Hickory Design Pty Ltd, Melbourne (AU)

(72) Inventor: George Argyrou, Elwood (AU)

(73) Assignee: HICKORY DESIGN PTY LTD., Victoria (AU)

( * ) Notice: Subject to any disclaimer, the term of this patent is extended or adjusted under 35 U.S.C. 154(b) by 0 days.

(21) Appl. No.: 17/632,888

(22) PCT Filed: Aug. 5, 2020

(86) PCT No.: PCT/AU2020/050808
§ 371 (c)(1),
(2) Date: Feb. 4, 2022

(87) PCT Pub. No.: WO2021/022334
PCT Pub. Date: Feb. 11, 2021

(65) Prior Publication Data

US 2022/0316210 A1 Oct. 6, 2022

(30) Foreign Application Priority Data

Aug. 5, 2019 (AU) ..... 2019902803

(51) Int. Cl.
*E04C 2/06* (2006.01)
*E04B 1/04* (2006.01)
(Continued)

(52) U.S. Cl.
CPC ..... *E04C 2/06* (2013.01); *E04B 1/043* (2013.01); *E04B 1/483* (2013.01); *E04B 5/04* (2013.01);
(Continued)

(58) Field of Classification Search
CPC ... E04C 2/06; E04C 2/044; E04C 2/46; E04C 2/50; E04C 5/12; E04B 1/043; E04B 1/483; E04B 5/04; E04B 2103/02
(Continued)

(56) References Cited

U.S. PATENT DOCUMENTS 2,482,836 A * 9/1949 Brickman ..... E01C 11/14 404/47
4,147,009 A 4/1979 Watry
(Continued)

FOREIGN PATENT DOCUMENTS

| | | | |
|---|---|---|---|
| ES | 2357628 | A1 | 4/2011 |
| WO | 2017219064 | A1 | 12/2017 |
| WO | 2017219069 | A1 | 12/2017 |

OTHER PUBLICATIONS

PCT Notification of Transmittal of The International Search Report ISR—Written Opinion; International Application No. PCT/AU2020/050808; International Filing Date: Aug. 5, 2020; Date of Mailing: Oct. 16, 2020; pp. 1-8.
(Continued)

*Primary Examiner* — Gisele D Ford
(74) *Attorney, Agent, or Firm* — CANTOR COLBURN LLP

(57) ABSTRACT

A method of constructing a reinforced concrete floor structure or wall structure, including: fabricating a precast panel substantially from concrete including a first set of parallel conduits extending through the panel, wherein the conduits open to opposite sides of the panel; moving the panel into its final position on a building site; and inserting tensioning cables through the conduits and tensioning the precast panel in the direction of the conduits to form a reinforced floor structure or wall structure, and a dowel connecting system for joining adjacent precast building panels, the system comprising elongated hollow dowel members cast in at the
(Continued)

edges of two or more precast building panels such that when the building panels are positioned adjacent to each other their respective dowel members are co-linearly aligned; and a dowel piece to be inserted into a recess of the co-linearly aligned dowel members and to extend across the building panels, wherein the recess of the dowel members is adapted to be filled with grout to anchor the dowel piece therein and thereby structurally joining adjacent building panels.

18 Claims, 8 Drawing Sheets

(51) Int. Cl.

| | |
|---|---|
| ***E04B 1/48*** | (2006.01) |
| ***E04B 2/00*** | (2006.01) |
| ***E04B 5/02*** | (2006.01) |
| ***E04B 5/04*** | (2006.01) |
| ***E04C 2/04*** | (2006.01) |
| ***E04C 5/12*** | (2006.01) |

(52) U.S. Cl.
CPC ..... *E04C 2/044* (2013.01); *E04C 2/46* (2013.01); *E04C 2/50* (2013.01); *E04C 5/12* (2013.01); *E04B 2103/02* (2013.01)

(58) Field of Classification Search
USPC ..... 52/581.5; 404/61, 62, 63
See application file for complete search history.

(56) References Cited

U.S. PATENT DOCUMENTS 4,221,098 A * 9/1980 Mayer ..... E04B 5/04 29/560
4,366,655 A 1/1983 Mayer et al.
5,005,331 A 4/1991 Shaw et al.
5,586,834 A 12/1996 Tsuji
5,674,028 A * 10/1997 Norin ..... E01C 11/14 404/74
5,911,538 A * 6/1999 Muller ..... E04B 1/483 14/73.1
6,363,671 B1 * 4/2002 O'Mara ..... E04F 15/225 52/480
6,389,774 B1 * 5/2002 Carpenter ..... E01C 11/14 52/741.11
6,471,441 B1 * 10/2002 Muller ..... E04B 1/483 404/62
6,517,277 B2 * 2/2003 Hu ..... E01C 11/14 403/294
6,832,454 B1 * 12/2004 Iyer ..... E04G 5/08 52/223.4
7,134,805 B2 * 11/2006 Yee ..... F16L 13/113 52/592.1
7,594,366 B2 * 9/2009 Viezens ..... E04G 23/0222 52/223.13
7,677,832 B2 * 3/2010 Yee ..... E04B 5/023 404/49
8,337,112 B2 * 12/2012 Kauppila ..... E04B 1/486 403/194
8,756,898 B1 * 6/2014 Backhaus ..... E04B 5/023 404/47
8,756,989 B2 6/2014 Backhaus et al.
8,911,173 B2 * 12/2014 Ulislam ..... E01C 5/06 52/223.6
8,919,057 B1 12/2014 Dupray
9,920,490 B2 * 3/2018 Sylvester ..... E01C 5/08
10,323,406 B2 * 6/2019 Hansort ..... E04B 1/4114
11,104,033 B2 * 8/2021 Sylvester ..... E01C 5/06
11,149,384 B2 * 10/2021 Smith ..... E01C 23/10
2005/0232697 A1 * 10/2005 Brinkman ..... E01C 11/14 404/47
2006/0080932 A1 * 4/2006 Van Rijn ..... B28B 7/306 52/705
2006/0140721 A1 * 6/2006 Shaw ..... E01C 11/14 404/60
2008/0098676 A1 5/2008 Hutchens
2010/0180519 A1 7/2010 Carrion et al.
2012/0282025 A1 11/2012 French
2013/0202355 A1 * 8/2013 Gibson ..... B29C 69/001 404/59
2014/0144102 A1 * 5/2014 Chen ..... E04C 2/243 428/223
2014/0270947 A1 * 9/2014 Ulislam ..... E01C 5/06 404/40
2015/0078822 A1 * 3/2015 Backhaus ..... E01C 5/06 404/47
2017/0356177 A1 * 12/2017 Lee ..... E04B 1/58
2019/0136507 A1 * 5/2019 Argyrou ..... E04G 21/12
2021/0277651 A1 * 9/2021 Zhou ..... E04B 1/4157
2022/0145626 A1 * 5/2022 Tanaka ..... E04C 5/073

OTHER PUBLICATIONS

PCT Notification of Transmittal of The International Search Report ISR; International Application No. PCT/AU2020/050808; International Filing Date: Aug. 5, 2020; Date of Mailing: Oct. 16, 2020; pp. 1-10.
Extended European Search Report issued in European Application No. 20849026.8 dated Jul. 5, 2023.

* cited by examiner

SECTION C-C

SECTION A-A

PRECAST BUILDING PANEL

CROSS REFERENCE TO RELATED APPLICATIONS

This application is a National Stage application of PCT/AU2020/050808, filed Aug. 5, 2020, which claims the benefit of Australian Application Serial No. 2019902803, filed Aug. 5, 2019, both of which are incorporated by reference in their entirety herein.

The present invention relates to a method of constructing a reinforced concrete floor or wall structure using a precast building panel, and to such panels used in construction. The invention also relates to a system for connecting adjacent building panels.

BACKGROUND

Building products and construction techniques are ever-evolving areas of technology. While tried and true methods remain firmly fixed in every day low-rise and high-rise construction, improvements and new technologies are constantly testing the building boundaries in the pursuit of optimizing building construction by developing faster, cheaper construction techniques that use less material, less human labour, or by using stronger products for higher, stronger results, or sustainable products and techniques for greener carbon footprints.

The industry of modular construction is a particularly viable and attractive industry as it aims to maximise in-factory construction time and minimize on-site building erection time. This not only shortens on-site construction time but minimises disruptions to surrounding site areas, which usually comprise a high density of existing buildings. Central to modular construction is the pre-cast concrete panel and the many ways of optimising the strength of the panel, building it faster and with less expense, and minimising the time to assemble pre-cast panels on site storey by storey.

It is these considerations that have driven development towards the present invention.

SUMMARY OF INVENTION

In accordance with a first aspect of the invention there is provided method of constructing a reinforced concrete floor structure or wall structure, including: fabricating a precast panel substantially from concrete including installing a first set of parallel conduits extending through the panel, wherein the conduits open to opposite side edges of the panel;

moving the panel into its final position on a building site; and inserting tensioning cables through the conduits and tensioning the precast panel in the direction of the conduits to form a reinforced floor structure or wall structure.

In a preferred embodiment the method includes installing a second set of parallel conduits extending through the panel substantially orthogonally to the first set of conduits and opening to second opposite sides, and inserting tensioning cables through the second conduits and tensioning the precast panel in the direction of the second conduits. This provides reinforcement across orthogonal planes in each panel. Of course, if a longer, thinner panel is formed, only reinforcement along the length of the panel may be required. Conduit recesses may be formed at one or both sides to where the conduits open. This provides space after the panels are assembled on site for workers to thread through the tensioning cable between panels and fix them in position, if required, using mechanical fastening means before filling in the recesses with grout.

The method preferably includes fabricating multiple precast panels; moving the panels into their final positions on a building site adjacent to each other and co-linearly aligning the conduit openings in adjacent panels; and inserting a tensioning cable through co-linearly aligned conduits and tensioning the cable through the co-linear conduits. A recess at the conduit opening is preferably grouted to anchor the cable into the floor or wall structure.

In one embodiment the panel is precast using a concrete slurry containing metal fibre.

In one aspect, the method includes fabricating a precast corner wall panel comprising perpendicular side panels with cast-in horizontal conduits extending through each side panel; erecting the corner wall panel on site to form a corner wall of a building; inserting cables through the conduits, applying tension to the cables and anchoring the tensioned cables to reinforce the corner wall.

The adjacent precast panels may be using a dowel connecting system. This would include casting dowel connecting tubes at the edges of the precast panels, the tubes having access slots leading from a front or upper face of the panel to respective recesses. The recesses of the dowel connecting tubes in adjacent precast panels would be aligned on site, and an elongated dowel piece inserted through the access slot to enter the dowel tube such that the dowel piece extends between adjacent panels. The method would include fixing the dowel piece in position by filling the dowel tubes with grout.

In one embodiment the precast panel could be fabricated upside down on a bed comprising a steel plate and a perimeter frame; providing formwork for recesses; placing a set of parallel post-tensioning conduits on the bed to follow a pre-calculated wave profile; pouring concrete slurry onto the bed and, when dry, lifting and turning the bed right side up; and releasing the precast panel from the bed.

In another aspect the invention also provides multiple building panels that are adjacently assembled to create a floor structure or wall structure, comprising building panels precast substantially from concrete and each panel including a first set of parallel conduits cast into the panels and opening to opposite sides of the panel, wherein the panels are assembled with conduits in one panel co-linearly aligned with conduits in another panel; and the floor structure or wall structure being reinforced by a tensioned cable extending through co-linearly aligned conduits.

The multiple building panels may further comprise a second set of parallel conduits cast into the panels to extend in a direction substantially orthogonal to the first set of conduits and opening to opposite sides of the panel.

According to the invention there is also provided a dowel connecting system for joining adjacent precast building panels, the system comprising elongated hollow dowel members cast in at the edges of two or more precast building panels such that when the building panels are positioned adjacent to each other their respective dowel members are co-linearly aligned; and a dowel piece to be inserted into a recess of the co-linearly aligned dowel members and to extend across the building panels, wherein the recess of the dowel members is adapted to be filled with grout to anchor the dowel piece therein and thereby structurally joining adjacent building panels.

The dowel member is preferably a tube having a resting channel and an access slot that provides a passage between the resting channel and an access opening of the dowel member. The access slot may have a narrower width than the width of the resting channel, and the dowel piece is preferably approximately twice as long as the dowel member. This allows the dowel piece to span over the small gap between the panels with approximately half of the dowel piece resting in the channel of one panel and the other half in the channel of the other panel. Accordingly, the dowel piece can provide a good anchor between the adjacent panels when fixed in place, i.e. by grout or concrete filler, or even by a geopolymer filler.

The dowel piece may be a single reinforcement rod, or it may comprise two parallel reinforcement rods connected by a spacer frame.

A method of joining adjacent precast building panels, including:

casting elongated hollow dowel members at the edges of at least two precast building panels, such that the dowel members are aligned perpendicularly, and are open, to a side edge of the building panels, and are additionally accessible from an upper or front face of the panels;

positioning the precast building panels adjacent each other so as to co-linearly align dowel members in the adjacent panels;

inserting a dowel piece into a recess formed by the co-linearly aligned dowel members such that the dowel piece extends across both building panels; and filling the recess of the dowel members with a cementitious filler that once dry hardens to structurally join the adjacent building panels.

The method preferably includes inserting the dowel piece into the recess by dropping the dowel piece through an access slot in each of the dowel members that communicates with a resting channel in which the dowel piece settles. The dowel pieces may be rebated into the upper or front face of the panels. To assist the dowel piece dropping into the resting channel, the dowel members can be cast into the panel in such a configuration that, after positioning the building panels adjacently, the resting channel is located lower than the access slot. The configuration will differ depending on whether the panel is a floor panel or a wall panel, where the access slot will be either angled or perpendicular to the front/upper face of the panel in order to lead to a relatively lower-positioned resting channel.

Described herein is a building panel comprising a precast panel that is cast substantially from concrete and having a set of parallel conduits extending through the panel and opening to opposite side edges, wherein post tensioning cables can be inserted through the conduits to tension the precast panel in the direction of the conduits.

In a second aspect and the precast building panel has a second set of parallel conduits extending through the panel substantially orthogonally to the first set of conduits and opening to second opposite side edges, wherein post tensioning cables can be inserted through the first and second conduits to tension the precast panel in two orthogonal directions.

If clarification is required, the term 'cable' is intended to mean a wire or strand that can be threaded through a conduit and be subjected to a tensioning stress. The term 'conduit' is a hollow plastic or metal duct of any cross-sectional shape that receives the cable that is threaded through the conduit. A 'tendon' is the collective term used to refer to a cable inside a conduit.

In an embodiment the panel has a reduced amount of reinforcing metal structures embedded in the concrete. The orthogonally placed tensioned cables in the final product create sufficient strength in the structure that metal reinforcement rods and mesh can be reduced across the panel. Put differently, some of the mid-span areas of the panel are devoid of additional reinforcement to the tensioned cables. However, in horizontal panels there may be additional reinforcement in the form of mesh and rods at so-called 'hot spots' in the panel. 'Hot spots' are defined as the areas in the panel that directly support load-bearing structures, such as columns and walls. Furthermore, consideration should be given to reinforcing the precast structure sufficiently in its transient un-tensioned state to be able to withstand forces and vibrations experienced during transportation and craning into position.

In a preferred embodiment the first set of conduits are parallel to each other and spaced along a length of the panel. Similarly, the second set of conduits are parallel to each other and are spaced along a width of the panel, wherein the length and width are at right angles in a panel plane. The panel therefore is a slab dimensioned to have a length, width and a depth. In one non-limiting embodiment the parallel tendons/conduits are spaced apart at approximately 1.0-1.5 metres. In the orthogonal direction (also referred to herein as 'perpendicular') the conduits are placed to weave over and under orthogonally-running conduits.

Post-tensioning is a means for reinforcing concrete. Post-tensioning is performed on in situ poured slabs where once the poured slabs are dry a continuous cable extending through conduits in adjacent slabs is tensioned to a predetermined force sufficient to create suitable reinforcement to the poured panel. However, it is unknown to perform post-tensioning techniques on precast panels. If a reinforcement technique is to be used (as opposed to cast-in reinforcement), precast panels are instead subjected to pre-stressing techniques where each panel is pre-stressed after casting, or pre-tensioning where the tendons are tensioned before casting the panel. Once the pre-stressed or pre-tensioned precast panels are delivered to the building site the panels, for example floor panels, are mounted on a building frame to form a floor and topped with a concrete topping which binds the panels together. Each technique offers its own benefits and efficiencies in building construction.

However, until now it has not been known to use post-tensioning reinforcement techniques on a precast panel, nor to manufacture a precast panel suitable for post-tension. It is counterintuitive to post-tension a precast panel because established post-tension and pre-stress techniques work adequately well. Furthermore, precast panels do not lend themselves to be post-tensioned.

The present invention to post-tensioning a precast panel offers specific advantages suitable for certain types of building construction. For example, in modular or prefabricated constructions the use of precast panels provides efficient and controlled fabrication of building components, regardless of environmental or worksite factors. Furthermore, post-tensioning allows for the reduction in reinforcement materials yet provides excellent reinforcement over longer spans, allows for thinner slabs and for rapid construction. A building formed from precast post-tensioned slabs can accordingly be constructed at a rapid pace, with material and labour cost savings and without compromise to structural strength and integrity.

The present invention involves inserting tension cables or wires through conduits in one or more precast panels after the panel has been erected or positioned on site. The tendon is then tensioned using a tensioning device at one end of the tendon while the other end is anchored in an anchoring pocket formed at an opposite edge of the precast panel. Put simply, the tensioned cable causes the slab to slightly deflect under compression. When a load is applied on the compressed part of the slab the deflection will lessen and compensate for the load, which creates a stronger structure.

While a preferred embodiment of the panel is devoid of significant metal reinforcing structures such as steel rods and meshes, an alternative embodiment comprises a panel formed from substantially a concrete mix reinforced with metal fibres in the quantity of from 15 kg metal fibres per cubic metre of concrete to 60 kg metal fibre per cubic metre of concrete. Such metal fibre reinforcement further still increases the strength of the pre-cast panel allowing for flow on advantages therefrom.

Metal fibres are more evenly distributed throughout the concrete panel compared to the more concentrated metal reinforcement of a metal bar or mesh and can more homogenously bear loads. Having metal fibres throughout a panel can effectively reinforce the entire panel slab, especially at tight or confined areas that are normally difficult to reinforce with structures such as mesh or rods. For example, the area at the edge of the panel between dowel recesses as disclosed herein is a confined area that is suited to metal fibre reinforcement. Metal fibre reinforcement is also effective for crack control as it slows down crack propagation in a concrete panel. There is also a reduced labour cost associated with metal fibre reinforcement in that it takes less effort during pouring a panel to have metal fibres already mixed into the concrete slurry than the additional step of adding reinforcement bars prior to pouring.

Also described herein is a method of constructing a precast building panel having two adjacent planar wall parts provided at substantially 90° to form an L-shaped corner panel, the method including:

preparing formwork defining the L-shaped panel wherein the formwork comprises a fixed L-shaped shutter and a movable L-shaped shutter whereby the panel is created in the space between the shutters;

introducing flowable fill into the space between the shutters from a lower end of the space such that the level of flowable fill rises in the space; and once the fill has dried, moving the movable shutter away from the fixed shutter to allow removal of the resulting precast building panel.

While greater consistency and quality control can be achieved in pre-casting panels in a factory setting, as opposed to casting in situ on site, pre-casting vertical panels that need to be moved is difficult. In this present aspect the inventive method achieves consistency, efficiency and a high quality resulting product. One advantage to the method is that filling the space between the shutters from a lower end of the space allows the flowable fill to compact under its own weight upon itself as the space fills, making for a stronger and less aerated structure. The fill is preferably flowable concrete, and the fill is preferably pumped into the space from a lower end.

In a preferred embodiment of the method, reinforcement is first assembled in the space before filling, where that reinforcement may be a reinforcing structure such as steel mesh or rods, or post-tensioning conduits for subsequent reinforcing after panel erection. Lifting lugs may also be cast into the panels to allow the resulting panels to be removed by lifting. The preparation step may also include preparing other features to be cast into the panel such as dowel recess structures and recesses for provision of post-tensioning apparatus. Flowable concrete may be formed by combining cement, aggregate and a plasticizer.

Accordingly, another embodiment provides a building panel formed from the above method of constructing a precast building panel having adjacent wall parts forming an L-panel, wherein the building panel includes reinforcement and/or post tensioning conduits.

In another aspect of the invention there is a building panel comprising a precast panel cast substantially from concrete and having two adjacent planar wall parts provided at substantially 90° to form an L-shaped corner panel, and each planar wall part having conduits extending horizontally through the planar wall part along the plane of the wall part plane so that post tensioning cables can be inserted through the conduits to tension the precast corner panel horizontally through both planar wall parts.

Each planar wall part preferably comprises a height, defining the height of the panel, the length, which defines the span of the panel, and a width, which can also be described as the depth of the wall part. The plane of the planar wall part is defined by the plane of the wall part height and the wall part length. The two planar wall parts are preferably formed into a corner at an adjacent vertical side of each planar wall part. Hence, a corner panel is formed by casting. As casting is carried out before erection of the panel at a building site, the panel is defined as being precast.

The building panel preferably comprises a plurality of parallel horizontal conduits in the form of duct lines precast into the panel. These duct lines extend all the way through the panel wall parts along their lengths and will be at right angles relative to the each other in each wall part, so that post tensioning cables can run through the length of each wall part and exit the other side.

In one embodiment the ducts in one wall part are horizontally offset from the ducts in the other wall part. This is so that at the corner edge of the panel the ducts in adjacent wall parts are staggered and will not meet, thereby avoiding post tensioning cables in one wall part interfering or overlapping with cables in the other wall part.

Further still, a post tensioning recess, essentially a pocket moulded into the panel, is provided at least at one end of each conduit, and preferably at both ends. The pocket is designed to accommodate post tensioning equipment that can be placed in the pocket after panel erection to post tension a row of building panels, whether corner panels or straight panels, by running a cable through aligned conduits in the panels and tensioning the cable to tighten the side-by-side abutment of the panels as well as to strengthen the panels. As post tensioning equipment generally pulls cables through in a longitudinal direction, the post tensioning pockets should be open at a side edge of the panel that is opposite to the conduit entry into the pocket.

In a preferred embodiment of this aspect, the building panel is reinforced with reinforcement bars, usually steel bars, but alternatives to reinforcement bars could also be employed, such as concrete embedded with metal fibres. Reinforcement bars or rods would be precast vertically with respect to the erected panel orientation. Furthermore, the bars would be spaced at similar intervals throughout the building panel but arranged staggered across the width of each wall part to avoid protruding into the conduits.

Vertically spaced horizontal dowel recesses may also be cast into the edges of the panel that are to be joined to other panels. Accordingly dowel recesses in adjacent building panels can be aligned and a dowel, in the form of a steel rod, plastic tube or the like, can be inserted into the aligned dowel recesses in order to horizontally hold the panels in position ready for post-tensioning.

The precast panel is preferably cast using concrete, a cementitious aggregate composite, but it is understood that the panel could include non-concrete material forming part of the panel body. In one such alternative foam panels could comprise the core of the building panel where concrete is moulded around the foam panel. This kind of panel is lightweight and finds use where weight is a construction priority at the expense of strength.

Further provided is a method of constructing a building wall using two or more building panels, wherein one of the building panels, at least, is a precast corner panel cast substantially from concrete and having two adjacent planar wall parts provided at substantially 90° to form an L-shaped corner panel, and each planar wall part having conduits extending horizontally through the planar wall part along the wall part plane; comprising erecting the corner panel and the second building panel close to each other;

aligning the second building panel adjacent the corner panel through a dowel system that connects joining sides of the panels against each other;

running post tensioning cables through aligned conduits in adjacent panels and anchoring one end of each cable relative to the building panel in which that end lies; tensioning the cable thereby pulling the cable tightly through the aligned conduits and fixing the cable to remain tightened in the conduits thereby creating a dry butt joint between the panels The method further comprises grouting the joint between the two panels.

The connecting system that connects the joining sides of adjacent panels is preferably a dowel connecting system.

BRIEF DESCRIPTION OF THE DRAWINGS

In order that the invention be more clearly understood and put into practical effect, reference will now be made to preferred aspects of the present invention. The following description is given by way of non-limiting example only and is with reference to the accompanying drawings, wherein:

FIG. 1(*a*) is an enlargement of Area A taken from FIG. 1;

FIG. 1(*b*) is an enlargement of Area B taken from FIG. 1;

FIG. 1(*c*) is an enlargement of Area C taken from FIG. 1;

FIG. 2(*a*) is an enlargement of Area D taken from FIG. 2;

FIG. 2(*b*) is a side sectional view taken along section E-E in FIG. 2(*a*);

FIG. 5(*b*) is a plan view of the building panel of FIG. 3 schematically showing construction of the building panel;

FIG. 6(*b*) is a side sectional view taken at section F-F of FIG. 6(*a*).

FIG. 8(*b*) is an underneath view of the dowel of FIG. 8(*a*);

FIG. 8(*c*) is a side sectional view taken at section C-C of FIG. 8(*a*);

FIG. 8(*d*) is an end view taken at section A-A of FIG. 8(*b*);

FIG. 9(*b*) is an underneath view of the dowel of FIG. 9(*a*);

FIG. 9(*c*) is a side sectional view taken at section C-C of FIG. 9(*a*);

FIG. 9(*d*) is an end view taken at section A-A of FIG. 9(*b*);

FIG. 10(*b*) is a side view of the dowel connecting system as seen at section X-X of FIG. 10(*a*).

DETAILED DESCRIPTION OF PREFERRED EMBODIMENTS

Figures 1, 1A, 1B, 1C:
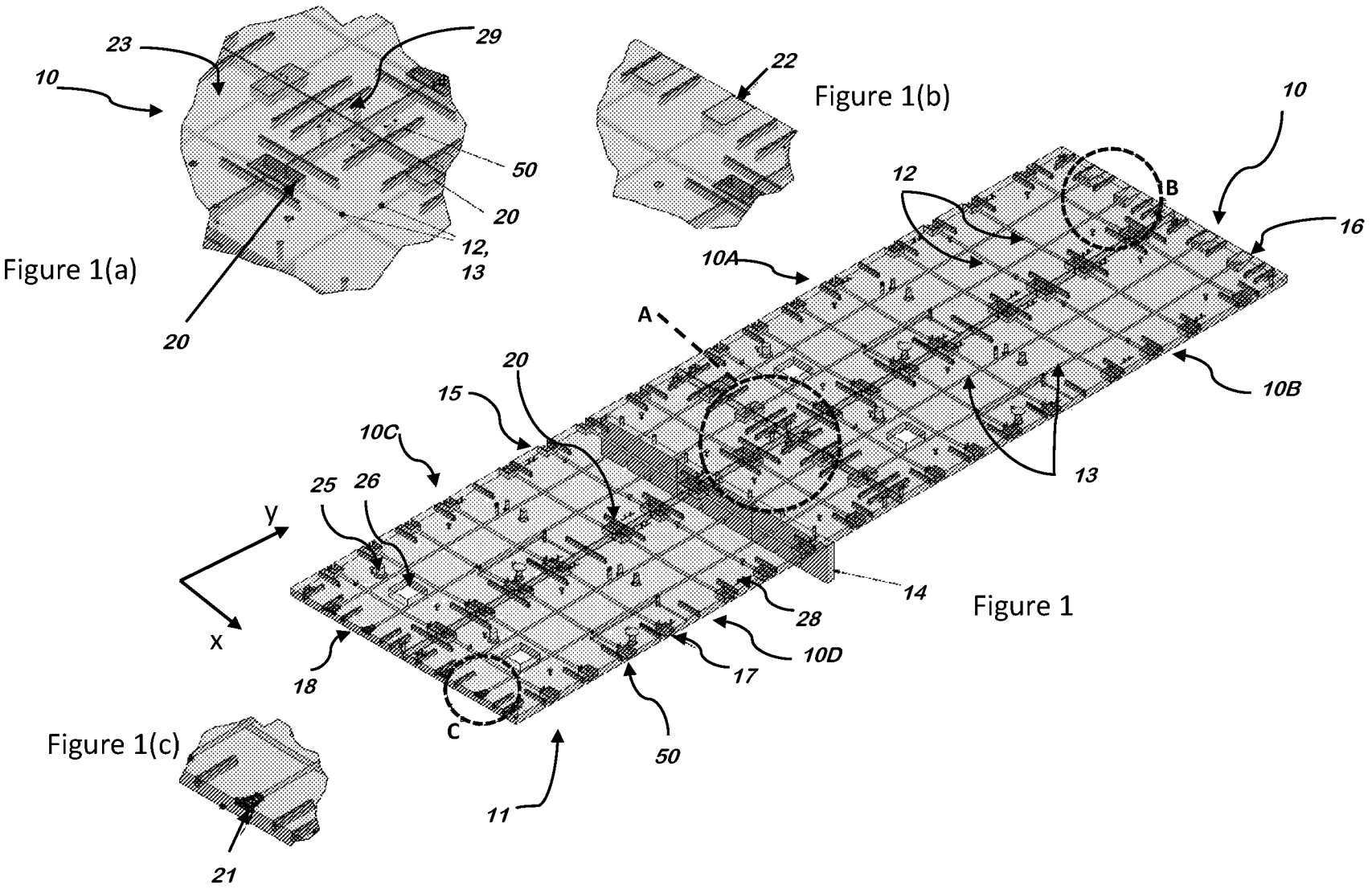
FIG. 1 is an isometric view of four building panels, in accordance with a first aspect of the present invention, arranged adjacent each other in a rectangular arrangement.

Various aspects of the invention are described herein and illustrated in the accompanying drawings. Several aspects are directed to the development of precast concrete building panels adapted to be formed off-site in a factory environment and then post-tensioned on-site after erection at a construction location. The concrete building panels are adapted for use as floors or walls in constructing a multi-level building. The building may be a low-rise or a high-rise building.

When the term 'concrete' panel is referred to herein, it is understood that this definition includes panels substantially made of concrete including, for example, concrete panels having a foam core, which may be useful for lightness or insulation if panel weight or thermal properties are important considerations. Further still, the term may include within it scope of definition panels made from a concrete composite, such as a geo-polymer concrete.

The post-tensioning of building panels poured and cast on-site is known. However, post-tensioning of precast panels that are made offsite then assembled and tensioned on site, is not known. Further still, post-tensioning of a precast panel in two lateral directions is not known.

Post-tensioning is a form of prestressing a reinforced concrete structure and has several advantages. Post-tensioning has the effect of placing a concrete structure, often a floor slab cast with metal reinforcement on site, under tension after the concrete has dried. Tension is applied between opposing ends of the structure, usually along its longer side, to compression stress the panel in an opposite direction to that which a load will be applied to the panel. For example, a second floor panel in a ten storey building will experience an amount of downward force from the load of the storeys above it that will cause the second floor panel to want to bend in a downward bowed direction in the areas where the panel is not directly supported underneath by support columns and walls. If prior to the application of the load the floor panel was prestressed in a direction to bow upwards, the end result after application of the load above will be a stronger floor panel having a straighter stress profile.

Flow on advantages of post-tensioning include the design of longer spans in elevated members, like floors or beams, with fewer support structures in between. Another advantage is that post-tensioning allows slabs and other structural members to be made thinner. Post-tensioning allows better building of slabs on expansive or soft soils. It also reduces shrinkage and cracking which means that fewer expansion joints/lines are needed. When cracks do form they are held tightly together and less likely to propagate.

Post-tensioning precast panels as described herein have advantages over simply using pre-stressed precast panels.

One advantage is that, aside from the convenience and efficiencies of off-site fabrication, the precast panels can be post-tensioned across multiple panels. This means that the reinforcement provided by the tensioned tendons continuously extends across multiple panels. This provides a force distribution along the length of the tendons, not just the length of the panels, which provides a longer reinforced span. In pre-stressed precast panels, the distribution of reinforcement is confined to each panel as a discrete unit, without continuing to adjacent panels.

Figures 2, 2A, 2B:
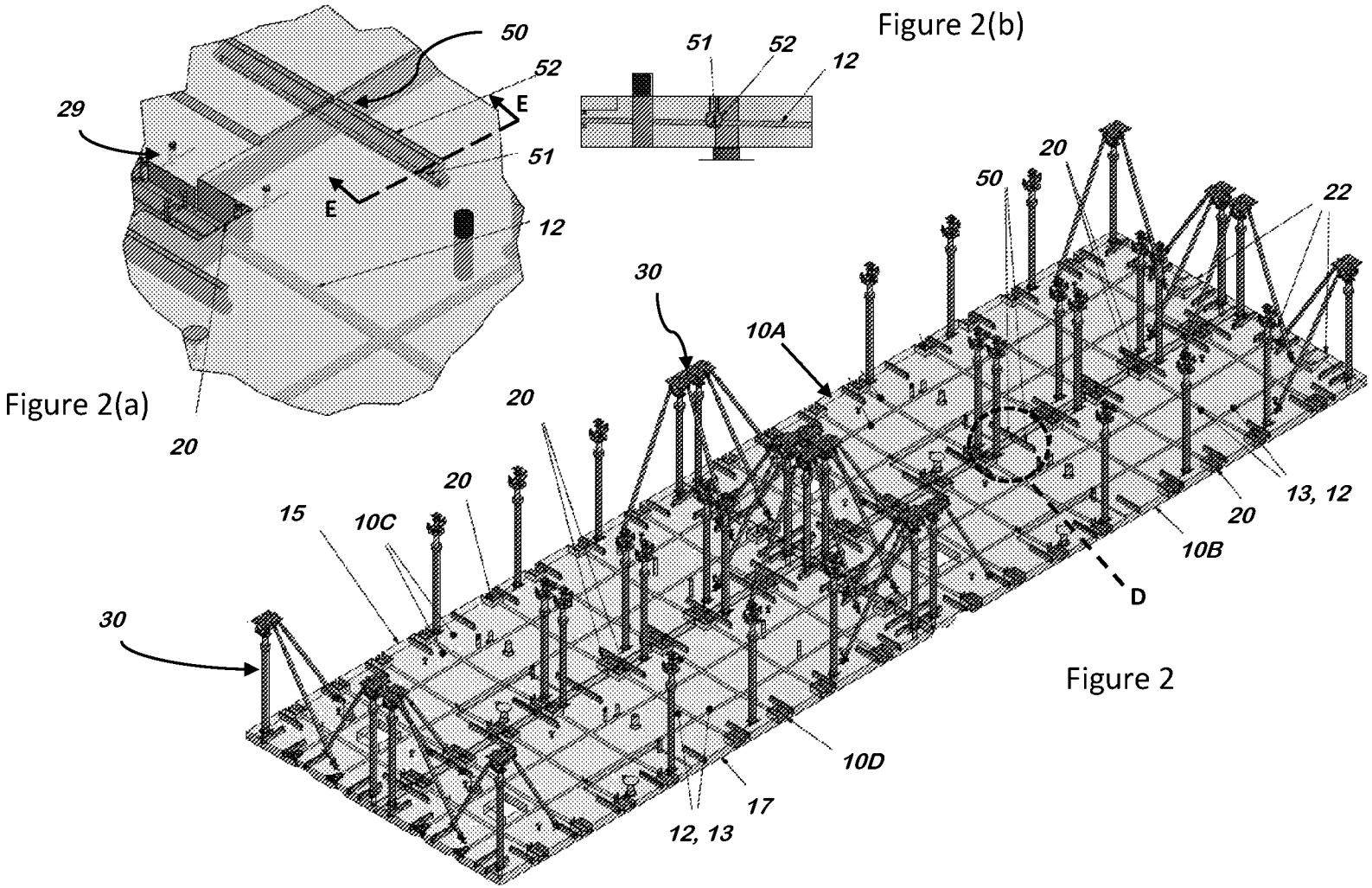
FIG. 2 is an isometric view of a similar arrangement of building panels shown in FIG. 1 but including temporary support structures.

FIGS. 1 to 2(*b*) illustrate an example of precast building panels 10 designed to be post-tensioned. The building panels 10 are substantially cast from concrete into a rectangular planar slab structure having a panel thickness. FIG. 1 specifically illustrates a matrix of four panels 10A, 10B, 10C and 10D arranged adjacently in a rectangle to form a floor structure 11. The casting process of the preferred embodiment is carried out in a controlled factory setting away from the time and environmental pressures associated with on-site construction. However, of course, it is understood that the casting process may also be carried out on-site with equal success.

During pre-casting, tendon conduits are placed between opposite ends of a casting bed, which acts as the casting template for the panel. The conduits are hollow metal conduits (or could be plastic) that provide access for high tensile metal cables (wires/strands) to be threaded through after the dried panel is erected on site and then tensioned to apply end to end compression to the panel. Multiple strands are often threaded through the same conduit (which may be elongated in cross-profile). The wire strands may have a diameter of between 10.0 mm to 20.0 mm. Two examples of commercially available standard diameters include 12.7 mm or 15.2 mm.

Particular to the presently illustrated precast panels, conduits are placed to extend through the panel in two crossed directions so that the panel can be post-tensioned in orthogonal directions in the plane of the panel, namely bi-axial post-tensioning as indicated by directions x and y of FIG. 1. However, it is within the ambit of the present invention to only provide parallel conduits in one direction, for example only in the y-axis direction shown in FIG. 1. It may be suitable with some panel designs to only require post-tensioning of a precast panel in one direction. For example, with narrow, long precast panels post-tensioning parallel tendons need only be required through the panel in the direction of the longer side.

Referring to the embodiment illustrated in the drawings of a precast panel designed for post-tensioning in two perpendicular directions, FIGS. 1 and 2 show a first set of parallel conduits 12 positioned to extend through the panel in the x-direction from a first side 15 to an opposite third side 17, while a second set of parallel conduits 13 extend in a perpendicular direction to the first set and along the y-direction from a second side 16 of each panel 10 to the opposite fourth side 18. All conduits 12, 13 have open ends that open to the sides of each panel 10 so that they can be connected co-linearly to adjacent conduits to form a longer conduit opening and to receive insertion of a tendon cable for tensioning.

FIG. 1, and the enlarged views of FIGS. 1(*a*), 1(*b*) and 1(*c*), illustrate the four pre-cast panels 10A, 10B, 10C and 10D joined together in a rectangular floor structure 11 by a dowel system 50 (discussed in more detail below) and each panel having its own series of spaced apart parallel first conduit set 12 extending in the x-direction and second conduit set 13 extending in the y-direction in a space apart relationship. Also illustrated is a supporting wall 14 below the floor structure 11.

As best inferred from the enlarged views, the pre-cast panels are each formed along their sides 15, 16, 17 and 18 to have pockets or recesses to which the conduits communicate and terminate. FIG. 1(*a*) illustrates interconnecting duct joint pockets 20 for the ends of the first or second set of conduits formed in adjoining side edges of panels that together form a larger duct joint pocket 20 between adjacent panels. Duct joint pocket 20 is recessed from an upper surface 23 of the panels and allows an operator access to the tendon cable during the post-tensioning set-up process to assist in a threaded cable finding the next conduit and, if required, to join together two cable ends using a coupler. Interconnecting duct joint pockets 20 are formed at a panel edge and at an opening end of a conduit in either the first or second set of conduits, where that panel edge is to be placed alongside an adjacent panel edge, and namely does not form the end edge of the floor structure.

Different recesses are formed at the panel edges where those edges form the end edges of the larger assembled panel structure. Referring to FIG. 1(*c*), a post-tension end anchor 21 is formed as a small recess at the conduit openings along edge 18, which edge will remain exposed and not be adjoined to another edge. The end anchor 21 is reinforced with embedded anchor points so that the end of a tendon cable can be hooked on or otherwise fastened to the end anchor 21.

At the opposite end of the assembled panel structure (here floor structure 11) to the end anchor 21 and along each conduit line is a further recess in the form of a post-tension stressing anchor 22, as best seen in FIG. 1(*b*). This recess is a larger recess ramped down from edge 16 to allow space for inserting a tensioning machine that can be securely attached to a cable threaded through the conduit to then tightly pull the cable horizontally away from the structure thereby tensioning the panels in a planar direction.

After the post-tensioning process is completed, the pockets and recesses are filled with grout or concrete to level off against the upper surface 23 of the panel 10 and to anchor the cable in place where the cable transitions between panels.

Although in FIG. 1 post-stressing end anchors 21 and stressing anchors 22 are only illustrated at the ends of conduits extending in the y-direction, there could be similar stressing anchor pockets in the x-direction to receive tensioning machines to tension cables in the x-direction. However stressing anchor pockets in the x-direction are not shown in the drawings. Alternatively, if room permits edge stressing using the tensioning machines can be carried out at the side pockets shown without need for stressing anchor pockets. Accordingly, the panel 10 is stressed in the x-y plane in both the x and y directions forming a type of cross-hatch pattern of evenly distributed stressed lines throughout the panel.

The building panels 10 shown in FIGS. 1 to 2(*b*) need not necessarily contain metal reinforcement in order to provide the requisite strength to support its own load and the load above it including the building storeys above it and building contents. Depending on the spacing between the parallel post-tensioning conduits in the so-called "two-way" orthogonal post-tensioned panel structure, a structure with smaller spacing between tensioned cables could be sufficiently strong by virtue of the stressed structure that it may be devoid of any significant metal reinforcement. This is also true if the precast panels are not required to hold a heavy load or if the vertical supports of a precast floor panel are positioned closer together.

Reinforcement of precast and cast in-situ building panels is well known. Metal reinforcement structures such as bars/rods and mesh have been commonly used for decades to reinforce a concrete structure including panels. However, the strength to a panel provided by two-way post-tensioning described herein is sufficiently strong to by comparison reduce the amount of metal reinforcement structure. Structural engineering calculations may be used to optimise the balance between the spacing between post-tensioning conduits and the amount of reinforcement structure used. Cast-in reinforcement may be focused on the 'hot spots' in the panel, which are the points that in an assembled state will be subjected to greater loading than other points in the panel. Accordingly, the precast panels illustrated in the drawings need not include any substantial separate reinforcement to that already provided by the post-tensioned cables. As already discussed, it may however be desired to use additional reinforcement depending on the construction design for which the panel is formed and the particular placement a panel has in a broader construction. Consideration for adequate reinforcement should also be given with respect to the panel's strength in a transient, un-tensioned state, for example during transit, such that the panel is able to be safely transported without damage before it is tensioned on site.

Further still, in the pursuit of a more economically made structure that can provide greater strength by comparison, the inventor has discovered a new effective reinforcement. In combination with the two-way orthogonal post-tensioning technique described above, the precast concrete panel can be devoid of any significant reinforcing metal structures embedded in the concrete, and instead be reinforced by metal fibres initially mixed into the concrete slurry before precasting. On the whole, the amount of metal in the metal fibres is significantly less than the amount of metal used in reinforcement structures including steel rods and mesh. This is thought to be because metal fibres provide a more even, or homogenous, distribution of reinforcement throughout the concrete panel than the more localized reinforcement of rods, which provide lines of reinforcement with gaps of no reinforcement in between, or metal mesh that provides crossed lines of reinforcement with gaps in between.

Furthermore, the metal fibres proposed to be introduced into the concrete slurry are profiled with end hooks or anchors to make them 'catch' onto the dried concrete, that is also stressed by post-tensioning, thereby providing a holding force on the concrete which mitigates crack propagation and movement within the precast concrete panel.

Figure 6A:
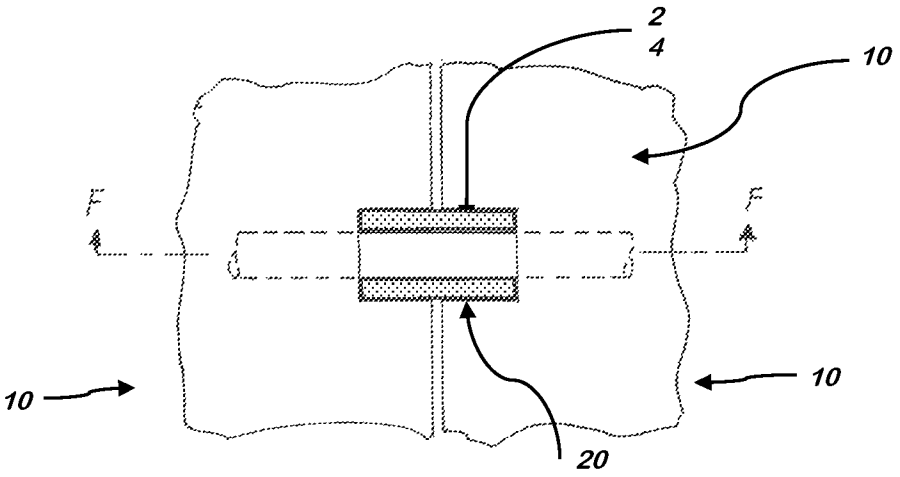
FIG. 6(*a*) is a schematic plan view illustrating the tendon connection between adjacent building panels such as those illustrated in FIG. 1.
Figure 6B:
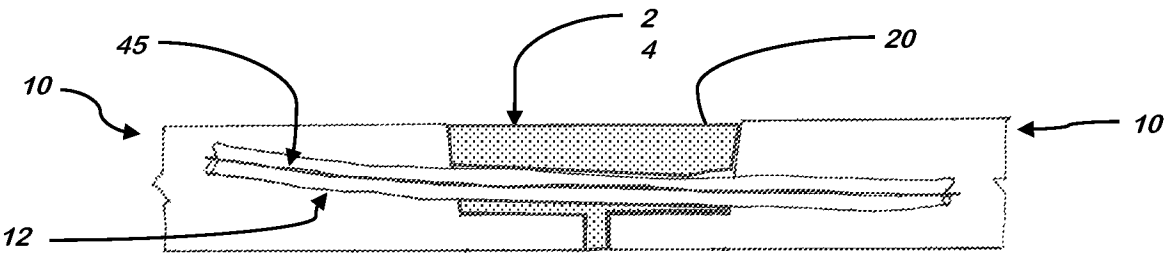

FIGS. 6(*a*) and 6(*b*) illustrate moment shear connections of post-tensioned cables 45 in conduits 12 at the post-tensioning duct joint pocket 20 between panels 10. The pockets 20 are illustrated in a finished form filled with grout 24. The tendons comprising conduits with cables do not run in a straight line through the precast panel but rather follow a sinusoidal, or wave-like, course through the panels where the tendons alternate with being closer to a top surface of the panel and a bottom surface. While not illustrated, the conduits 12 cast into panels 10 can be joined together at their ends to provide a continuous passage through which cable 45 can be inserted. Alternatively, a gap can remain between adjoining conduits as long as the cable can traverse the gap. Manual assistance may be required in threading the cable between panels. As discussed above, having a continuous cable or tendon extending through multiple precast panels applies a longitudinal reinforcement that continuous across the panels as if the panels in the area of the cables were one large elongated structure, like a beam. Added to this improved structural reinforcement is the advantage of precast panels and their efficiency in fabrication and installation.

Figure 7A:
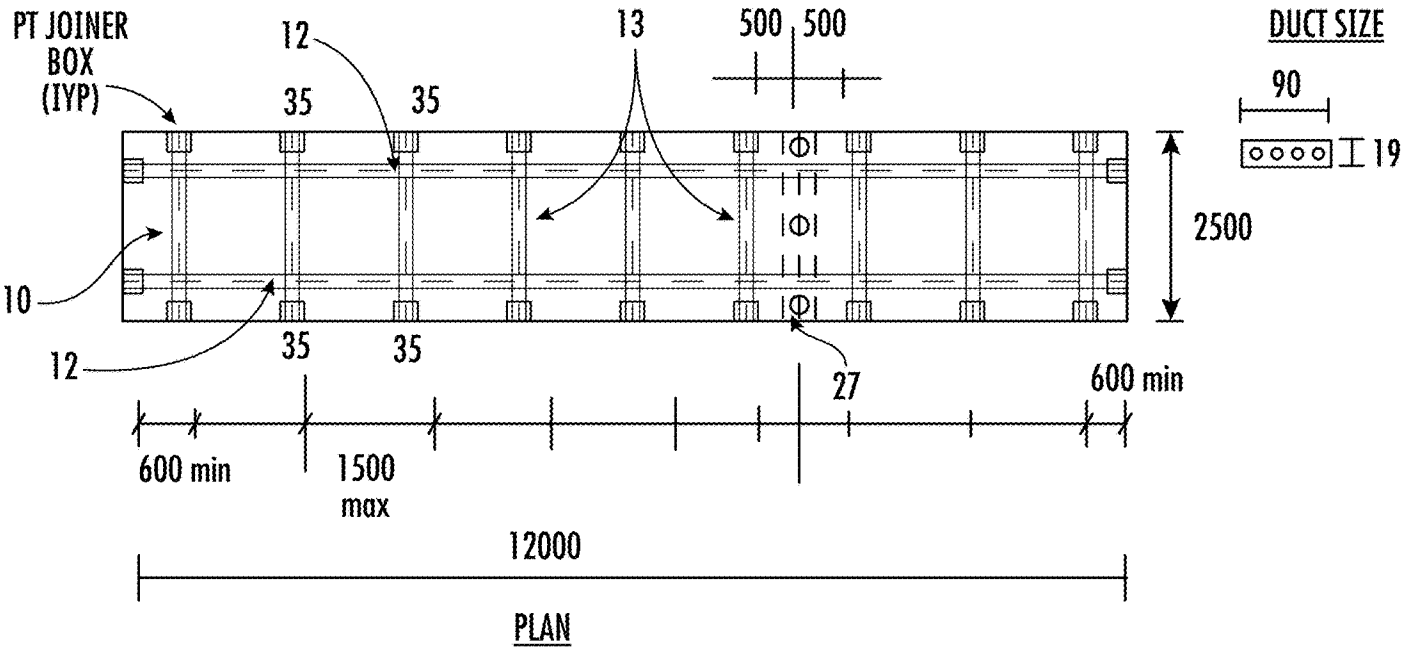
FIGS. 7(*a*) and 7(*b*) are schematic plan and side section views respectively illustrating post-tension duct arrangement between adjacent building panels.
Figure 7B:
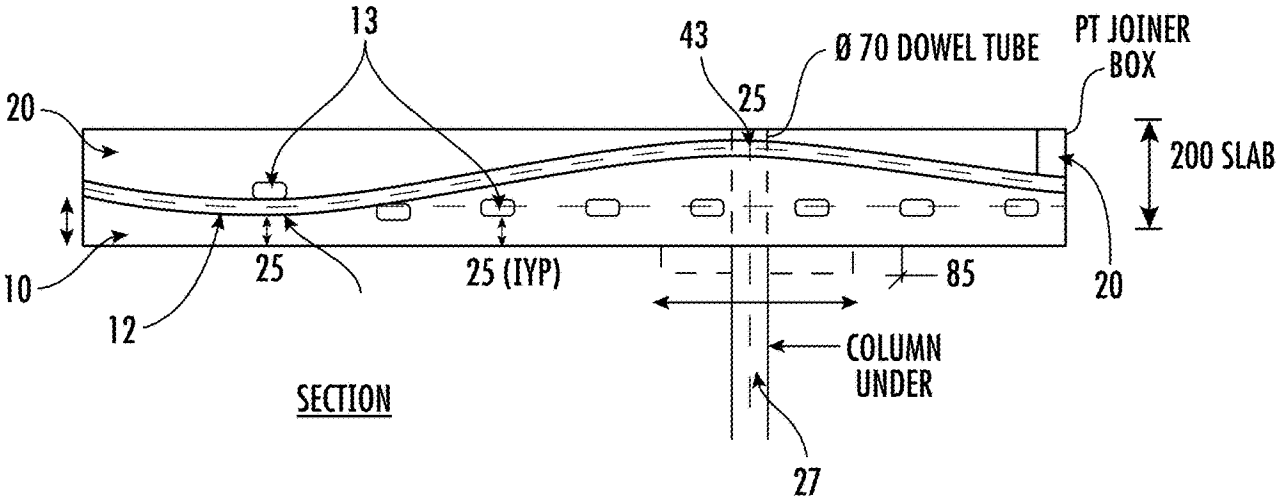
Figure 8A:
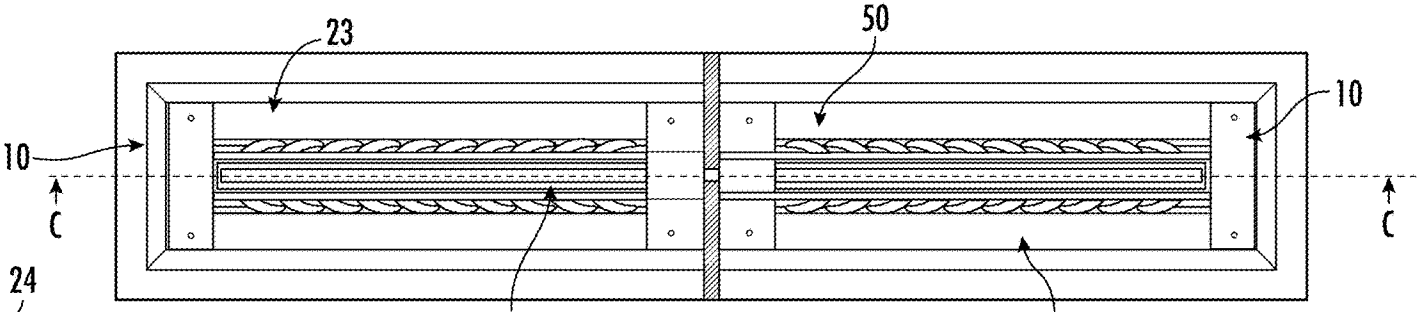
FIG. 8(*a*) is a plan view of a dowel connecting system using a single dowel rod.
Figure 8B:
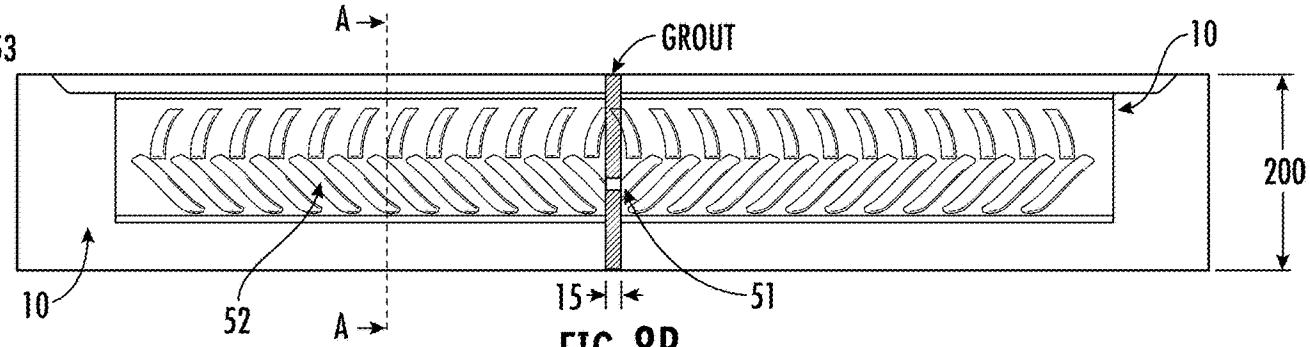
Figure 8C:
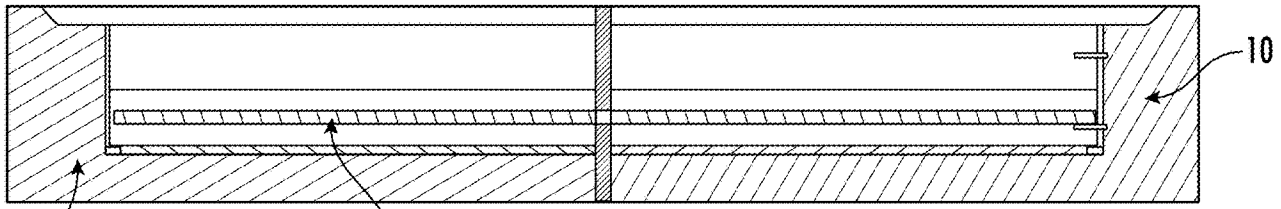
Figure 8D:
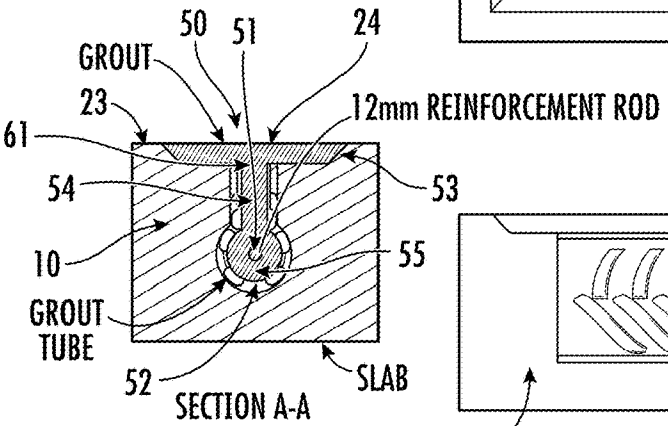
Figure 9A:
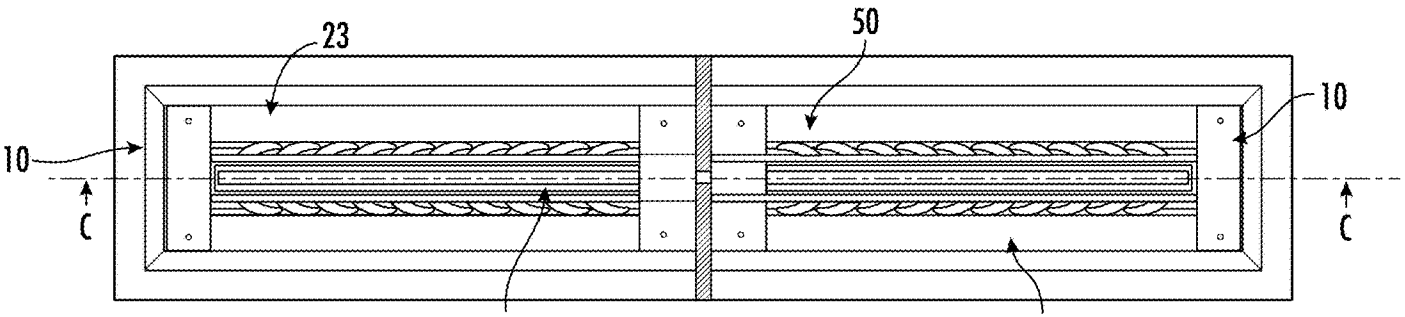
FIG. 9(*a*) is a plan view of a dowel connecting system using a double dowel rod.
Figure 9B:
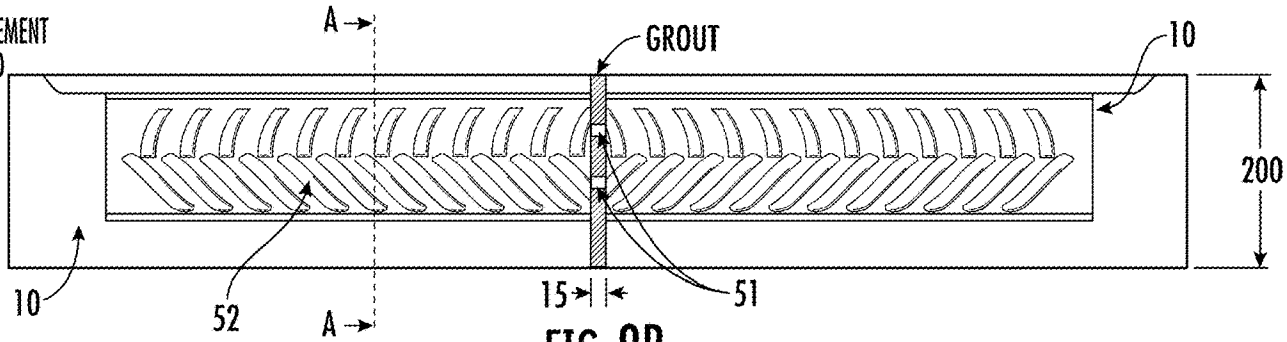
Figure 9C:
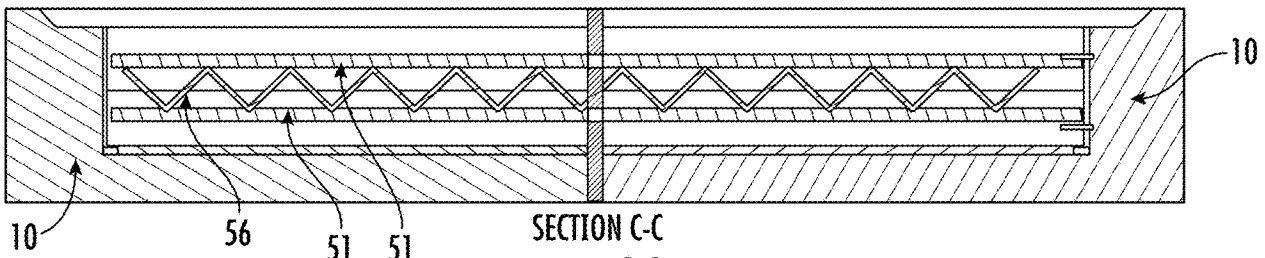
Figure 9D:
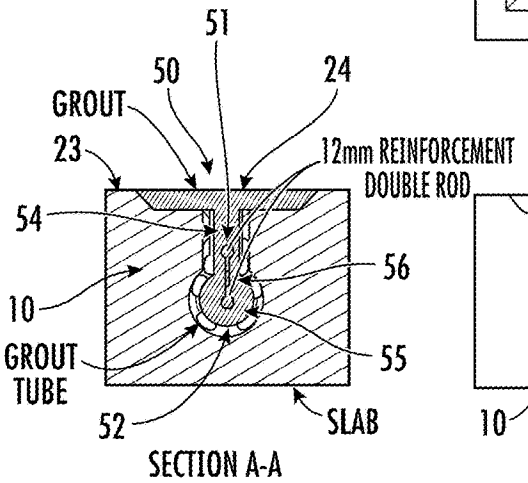

FIGS. 7(*a*) and 7(*b*) show the profile of the precast conduits 12, 13 in a plan view and a section view. The conduits are not necessarily cast in the panels 10 in a straight horizontal plane. To provide for an anticipated load on a panel, the conduits are cast in a profile that when cables inside are post-tensioned stresses the panel against the anticipated load by tensioning the panel in an opposite direction to the bending moment of the panel. This stressing provides for a stronger, optimised structure. The profile will vary according to the building plans. Specifically, the precast profile is in a wave-like or sinusoidal form that accounts for points of a panel designed to be supported below by a column requiring less strengthening and stressing, while the points in the panel that are midway between two supporting columns requiring more strengthening and therefore stressing.

FIG. 7(*b*) shows such an example of a panel 10 supported by a column 27. A single first conduit 12 from the first set of conduits is seen in longitudinal profile, and a number of second conduits 13 from the second orthogonal set are seen in cross-section overlapping and underlapping the first conduit 12. The first conduit 12 is cast into the panel to follow a wave-like or parabolic/sinusoidal path. The crest 43, also referred to as a high point, of the wave coincides with the column support, while the trough 44, also referred to as a low point, of the wave occurs where no under-support is provided, namely mid-span of the panel. When tension is applied to a wire within conduit 12, the tensile force will cause the wire to want to pull into a straight line which thereby applies a stress load at the crest 43 and trough 44 of the wave profile. Since the crest 43 of the wave in FIG. 7(*b*) sits above supporting column 27, there will not be much affect or movement on the crest of the wave profile. However, trough 44 being unsupported will tend to want to bend upwardly which has the affect of prestressing the panel 10 at trough 44 against a downward load on that same part of the panel.

The conduit profile of first conduit 12 as shown in FIG. 7(*b*) is replicated for all conduits in the first and second sets 12, 13 extending at right angles to each other. Understandably, design planning will need to be done to ensure that while each conduit follows an optimised wave profile, each conduit also needs to be spaced from and avoid intersecting with each other conduit. The result is a precast panel that is tensioned on site that is particularly strong as it is tensioned in two orthogonal directions with optimised stress profiles directly related to the building plan for construction.

Returning to FIG. 1, the panel 10 is illustrated pre-cast with fittings 25 such as plumbing pipes and service recesses 26 for access throughout the building to electrical and ventilation services and the like. Also illustrated are location lugs 28 protruding upwardly from the upper surface 23 of the panel 10 to locate wall panels and columns vertically on top of the floor structure 11. Attachment points 29 on the floor panels 10 are adapted to provide fastening locations for temporary support structures used in the construction process of a multi-level building.

FIGS. 2, 2(*a*) and 2(*b*) illustrate temporary support structures 30 used in the construction of multi-storey buildings using modular units. The apparatus and method relating to the illustrated temporary support structures is the subject of co-pending patent applications by the same applicant and published as WO2017/219064, which description is incorporated herein by reference.

The attachment points 29 are cast into each panel 10A, 10B, 10C and 10D and are used to anchor the temporary support structures 30. Anchoring of the temporary support structures is performed in the factory setting and each panel with temporary support structures anchored in place is then transported to the construction site where the panels are modularly assembled floor by floor using known assembling techniques and/or the methods described in co-pending patent application WO2017/219064 identified above.

A further method for connecting adjacent building panels, particularly but not exclusively, precast building panels, is described herein and involves a dowel connecting system 50 briefly alluded to above. The dowel connecting system minimises time and material in assembling building panels adjacently together to form a larger planar structure such as a floor or wall. It does this by minimising the amount of wet concrete required on-site to stitch the panels together.

The dowel connecting system 50 is best seen in FIGS. 2(*a*), 2(*b*), 8(*a*) to 8(*d*), 9(*a*) to 9(*d*), and 10(*a*) and 10(*b*).

The dowel connecting system 50 uses a dowel piece in the form of a rod-like member, which can be a hollow plastic tube or a solid structure such as a metal or wooden cylinder. In the embodiments shown the dowel connecting system comprises an elongated hollow dowel member in the form of a dowel grout tube 52 having a recess into which a dowel rod 51 is placed and grouted in. The recess of the dowel tube 52 is defined by an access slot 54 and a parallel resting channel 55. The dowel rod need not be circular in cross-section but could be square, or other shape. However, a circular cross section will assist in placement of the dowel, as discussed further below.

FIGS. 8(*a*) to 8(*d*) and 9(*a*) to 9(*d*) show that the precast panels are cast with the access slots 54 of the dowel tubes 52 opening up at an access opening 61 to a shallow depression or rebate 53 the upper surface 23 of each panel 10 and spaced around the panel along the edges at each panel side 15, 16, 17 and 18. The dowel tubes 52 are elongated and shaped similarly to the dowels, but larger than the dowels, for receiving the dowel. In some embodiments the dowel recesses are teardrop or upside-down keyhole shaped in cross-section. The length of the dowel tubes 52 in each panel is smaller than the length of the dowel rods 51 because dowel tubes 52 in adjacent panels are adapted to be aligned to create a single long dowel recess into which the dowel rod 51 can be inserted so that the dowel spans across two dowel recesses, and therefore two panels. The dowel tubes are cast into the panel so that the height of the tube is perpendicular to the top side edge of the panel.

Once the panels are assembled on site with dowel tubes in adjacent panels lining up in a co-linear arrangement, the dowel rod 55 is dropped into the aligned dowel tubes 52. Rebate 53 is wider than access slot 54 and runs a little longer than the length of dowel tube 52. Rebate 53 cast into the upper surface 23 of panel 10 also has ramped side walls that have the effect of encouraging rod 51 towards access slot 54 should the dowel rod be dropped into the rebate 53. Once the rod 51 enters the access slot 54 it drops into channel 55. Rod 51 may sit at the bottom of the channel 55 or, as shown in the drawings, be suspended by brackets or the like at the ends of the channel 55 to extend through the centre of the channel.

Two different embodiments of dowel rod 51 are illustrated in the drawings. FIGS. 8(*a*) to 8(*d*) illustrate a single dowel rod extending across the co-aligned cavities of the dowel recesses in tubes 52. FIGS. 9(*a*) to 9(*d*) illustrate a double dowel rod 51 which comprises two parallel reinforcement rods 51 attached together in a spaced-apart relationship by a spacer frame 56. A double dowel rod 51 provides a stronger connecting anchor between the panels than a single dowel rod.

Once the dowel rods 51 have been inserted in position in the tubes 52, the tubes are filled with a cementitious filler, foreseeably concrete, cement or a grout mix 24, which dries and hardens to fix the dowel in place thereby providing a permanent structural connection between the two adjacent panels.

As shown in FIGS. 2(*b*), 8(*d*) and 9(*d*), the access slot 54 opens to the upper surface 23 of the panel 10 where the panel is a floor slab or the outer vertical surface where the panel is a wall thereby allowing an installer to insert a dowel into the access slot. The access slot is narrower than the resting channel to discourage the dowel dislodging from the channel, however this is unlikely to occur because the configuration of the dowel recess in the panel is such that, whether the panel is for use as a horizontal floor panel or a vertical wall panel, the resting channel 55 is located lower than the access slot 54 so that gravity will assist in locating the inserted dowel in the channel and prevent its unintentional removal.

Figures 10A, 10B:
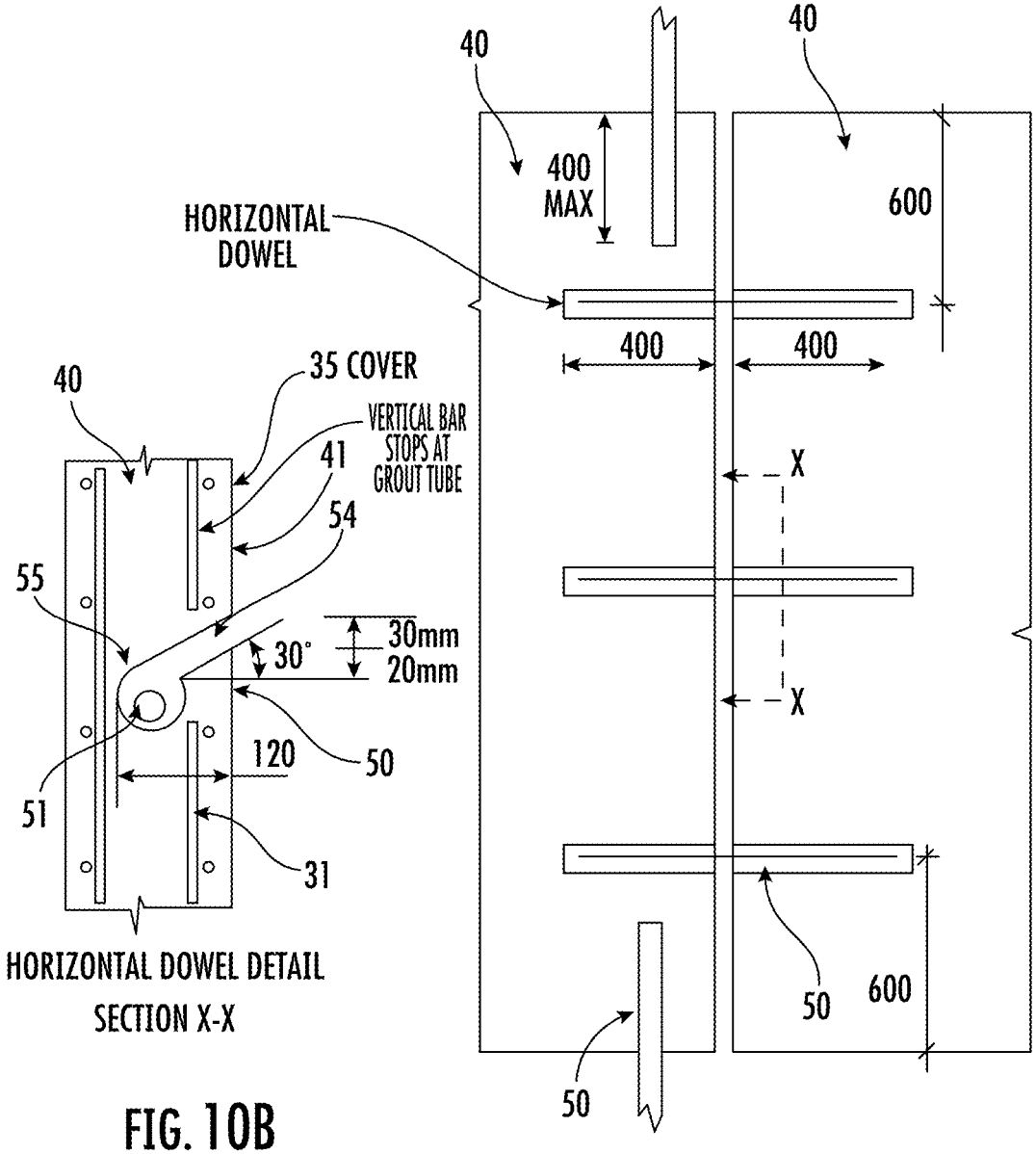
FIG. 10(*a*) is a schematic front view of a dowel connecting system for use between adjacent upright panels.

This feature of a lower resting channel 55 compared to the access slot 54 can be seen in the floor panels of FIGS. 2(*b*), 8(*c*), 8(*d*), 9(*c*) and 9(*d*), while FIGS. 10(*a*) and 10(*b*) illustrate the dowel system in a wall panel 40. Here it can be seen that the access slot 54 opens up to a front, outer wall surface 41 and is cast to angle downwardly to the cylindrical resting channel 55 formed internally of the wall panel 40. The access slots and resting channels of adjacent wall panels 40 align together to receive the dowel 51 that spans across both slots and channels in both wall panels 40.

Figure 3:
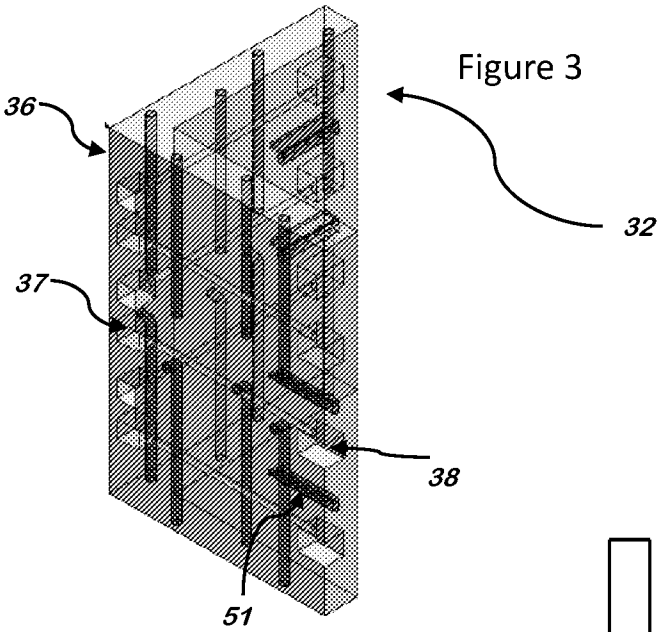
FIG. 3 is an isometric view of a building panel in accordance with another aspect of the present invention.
Figure 5B:
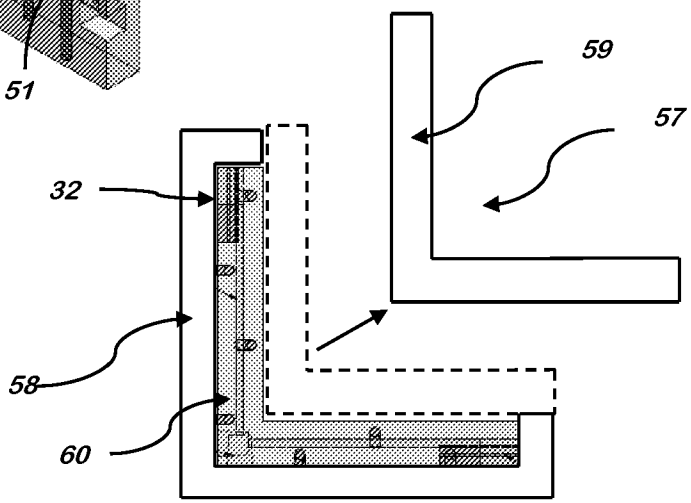
FIG. 5(*a*) is a plan view of the building panel of FIG. 3.
Figure 5A:
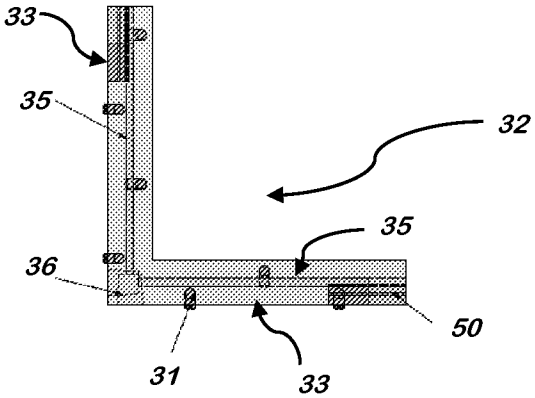
Figure 4:
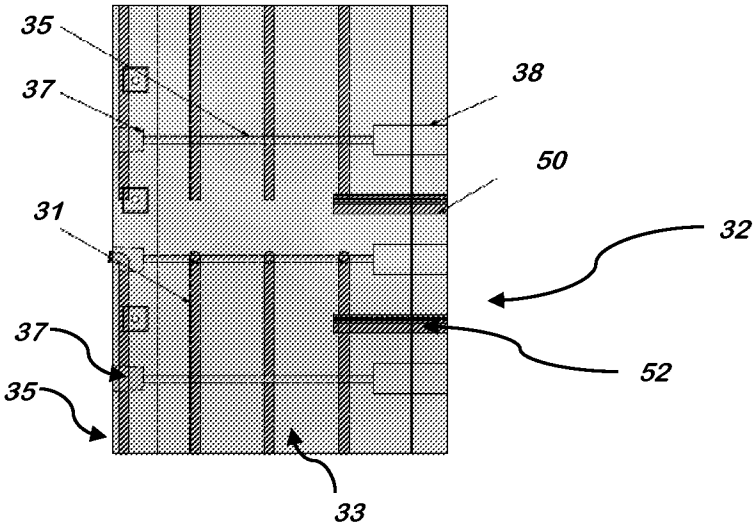
FIG. 4 is an elevated side view of the building panel of FIG. 3.

FIGS. 3, 4 and 5(*a*) and 5(*b*) illustrate an aspect of a building panel described herein in the form of a precast L-shaped corner panel 32 that has been cast in one casting process as a single component and comprises two adjacent planar wall parts 33, or side panels, provided at substantially 90° to each other to form a corner panel. Each planar wall part has cast-in post-tensioning conduits 35 extending horizontally through the planar wall part along the wall's plane so that post tensioning cables can be inserted through the conduits to tension the corner panel horizontally through both planar wall parts.

Each planar side wall part preferably comprises a height, defining the height of the panel, the length, which defines the span of the panel, and a width, which can also be described as the depth of the wall part. The plane of the planar wall part is defined by the plane of the wall part height and the wall part length or in other words the x-y plane, using the cartesian coordinates referred to in respect of the floor panel structure. The horizontal conduits 35, also referred to herein as duct lines, extend along the plane of each wall part 33 so that the conduits in each respective wall part run at right angles relative to each other, as will the post-tensioning cables that are inserted through each conduit and pulled in tension.

So that the tensioning cables can be pulled in both right angle directions and to avoid interference and overlapping with each other, the conduits in the adjacent wall parts are staggered to not meet at the corner 36. As with the floor panels 10A-10D, the wall parts 33 are cast with conduit recesses at the ends of the conduits where they open at the side edges of the wall parts 33. FIGS. 3 to 5(*a*) illustrate post-tensioning pockets 37 vertically cast along the corner 36 alternatingly communicating with one wall part then the next. These pockets 37 can act to anchor the end of a tension cable or to allow access to post-tensioning equipment for carrying out the post-tensioning process. The opposite end of each conduit 35 opens to a duct joint recess 38 that can be aligned with similar horizontal duct joint recesses in adjacent panels, which are likely to be straight panels and not corner panels. The duct joint recesses are to join cables together and/or strengthen the through-cable with couplers.

In the embodiment of the corner panel 32 illustrated in FIGS. 3 to 5(*a*), the panel is reinforced with metal reinforcement bars 31. The bars are precast vertically into the wall parts 33 but staggered evenly one to either side of the conduits 35 to avoid protruding into the conduits 35. A similar arrangement would apply with the floor panels 10A-10D should reinforcement bars be used in that floor structure arrangement. Alternatively, the corner panel 32 may not require a reinforcement structure such as metal rods if the concrete mixture includes metal fibres, as described in the embodiments above.

FIGS. 3, 4 and 5(*a*) also illustrate the corner panel 32 having a dowel connecting system 50 where the dowel pieces in the form of dowel rods 51 insertable in dowel tubes 52 are vertically spaced along vertical edges of the corner panel. A dowel connecting system such as that shown in FIGS. 10(*a*) and 10(*b*) would be suitable for the corner panel 32. It is also envisage that, as also illustrated in FIG. 10(*a*), vertically-oriented dowel rods 51 and dowel tubes 52 could be used to connect panels adjacently located one above another. The theory behind this vertical connection using the dowel connecting system 50 is the same as the horizontal connections described above, namely dowel rods 51 would be received in dowel tubes 52 of adjacently aligned panels, and then the recesses in the tubes 52 filled with grout or a concrete mixture in order to set the dowels permanently in place thereby fixing together the two panels.

The method of making flat panels or corner panels in a factory setting involves transposing design drawings of the desired flat or corner panel onto a casting template in the form of a welded bed. The casting process for the corner panel is schematically illustrated in FIG. 5(*b*).

For forming the L-shaped corner panel, a vertical formwork structure 57 is used as shown in FIG. 5(*b*), which shows the vertical structure in plan view. The structure includes a fixed L-shaped shutter 58, where the shutter can be made of known formwork materials such as a timber frame and form board. A nested moveable L-shaped shutter 59 moves towards the fixed shutter 58 leaving a space 60 which creates a corner cavity into which concrete is provided to from a corner wall. The movable shutter 59 moves away from the fixed shutter 58 in the direction of the arrow after the concrete has dried in order to release the dried corner wall 32 from the form structure. The movable shutter may have set distances away from the fixed shutter to vary the thickness of the corner panel to be formed.

Fittings, moulds and recesses similar to those used in the flat panel are welded or otherwise attached to the vertical formwork structure. Lifting lugs may also be cast into the top of the resulting structure to allow it to be lifted after forming. A self-compacting concrete, which is a flowable fill, is pumped into the space between the shutters from a bottom opening in the formwork structure to fill the corner cavity upwardly until the requisite corner wall height is reached. As the concrete fills the space the flowable nature of the concrete compacts upon itself, which has the effect of mitigating aeration in the resulting structure and increasing strength. After the concrete dries, the moveable shutter is moved away from the dried corner wall whereby the corner wall can be cracked away from the shutters and lifted or otherwise removed from the corner mould.

Reinforcement is assembled in the space before filling. In the embodiment illustrated in FIGS. 3 to 5(*b*) the reinforcement is a combination of horizontal post-tensioning tendons and vertical steel rods. However, in the process described above any suitable reinforcement may be used including a steel mesh structure, steel rods or merely post-tensioning conduits for receiving cables to be post-tensioned.

Any suitable flowable fill may be used as the material for pumping into the corner panel. In the preferred embodiment the fill is a flowable concrete using an aggregate cement mix combined with a plasticizer.

Forming a flat panel involves a casting process that is carried out upside-down on a welded bed. The bed is a steel plate with a perimeter frame forming the perimeter of the precast panel. All necessary fittings and penetrations are welded to the bed to provide for location anchors, plumbing and electrical services, etc. Fixed moulds are used to form the recesses in the panel for dowel recesses and post-tensioning pockets. Post-tensioning conduits are then placed in a first direction and a second perpendicular direction, and held in position in the bed following an undulating wave profile calculated for optimisation in the planning process.

Once all fittings, moulds and conduits are in place the panel is cast using a concrete slurry, which in one preferred embodiment includes metal reinforcement fibres, as discussed above. If reinforcement fibres are not added to the concrete slurry then reinforcement structures in the form of metal mesh or rods will need to be laid in the bed before casting. Extra reinforcement at 'hot spots' may be required, regardless.

Once dry, the concrete panel and bed are tilted upwards using a gantry and turned upside, whereby the panel is released from the bed. The same bed could be used to make 20-30 panels. The upper surface of the panel will be smooth and even because the upper surface was formed upside down facing the smooth steel plate of the welded bed. Such a smooth finish is desirable in some design circumstances where a polished concrete floor is desired as the surface will require less honing and finishing to achieve an aesthetic result compared to a concrete floor cast in-situ or facing upwardly.

The above description details improvements in forming, strengthening and joining concrete panels, particularly panels that are precast and modularly assembled on a building site. Previously, it has not been known to provide post-tensioning conduits in precast panels, in one or two directions. Post-tensioning has been commonly associated with in-situ casting of panels and slabs. However, there are significant advantages that derive from the presently described precasting technique. Advantages include those already discussed above, namely a reduction in materials used without compromising structural strength, and reduction in labour and speedier construction times, which also translate to cost reductions. The cost savings over a 10-20 storey building can be substantial. Furthermore, strengthening the span of floor panels in multi-storey buildings means smaller columns can be used to support the structure between floors. Not only do smaller columns require less material but they also provide greater floor space.

The presently described technique for forming precast corner panels means that a complete building wall structure can be created in a factory setting. Previously, while flat wall panels were created in a factory setting, corner panels needed to be cast on-site. Alternatively, flat panels can be butt-jointed into a corner on site but joining flat panels at a corner creates its own set of problems and can result in points of structural weakness.

The products and methods described above also provide for greater flexibility in building design in that the concepts can be used to form any size floor or wall panel according to the corresponding architectural design. Notably, the concepts described herein lend towards maximising in-factory fabrication of buildings or part of buildings. In particular, the presently described techniques are suitable for manufacturing modular building components, such as pods or part pods, that can be transported and modularly assembled on-site in a fast and efficient manner.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, namely, to specify the presence of the stated features but not to preclude the presence or addition of further features in various embodiments of the invention.

It is to be understood that the aforegoing description refers merely to preferred embodiments of invention, and that variations and modifications will be possible thereto without departing from the invention, the ambit of which is to be determined from the following claims.

The invention claimed is:

1. A dowel connecting system for joining adjacent precast building panels, the system comprising:

elongated hollow dowel members cast in at the edges of two or more precast building panels such that when the building panels are positioned adjacent to each other their respective dowel members are co-linearly aligned, wherein the dowel members each include a longitudinal resting channel and a parallel access opening that opens along the length of the dowel member to an upper or front face of the respective panel; and a dowel piece to be inserted into a recess of the co-linearly aligned dowel members and to extend across the building panels, wherein the recess of the dowel members is adapted to be filled with grout to anchor the dowel piece therein and thereby structurally joining adjacent building panels.

2. The dowel connecting system claimed in claim 1, wherein the dowel member is a tube having the resting channel and an access slot providing a passage between the resting channel and the access opening of the dowel member.

3. The dowel connecting system claimed in claim 1, wherein the dowel piece is approximately twice as long as the dowel member.

4. The dowel connecting system claimed in claim 1, wherein the dowel piece is a single reinforcement rod, or comprises two parallel reinforcement rods connected by a spacer frame.

5. Multiple building panels that are adjacently to joined using the dowel connecting system claimed in claim 1, wherein the multiple building panels create a floor structure or wall structure and are precast substantially from concrete,_ and each panel including a first set of parallel conduits cast into the panels and opening to opposite sides of the panel, wherein the panels are assembled such that conduits in one panel co-linearly align with conduits in another panel; and the floor structure or wall structure being reinforced by a tensioned cable extending through co-linearly aligned conduits.

6. The multiple building panels as claimed in claim 5, further comprising a second set of parallel conduits cast into the panels to extend in a direction substantially orthogonal to the first set of conduits and opening to opposite sides of the panel.

7. The multiple building panels as claimed in claim 5, wherein before casting in concrete the conduits are arranged to follow a pre-calculated wave profile.

8. A method of joining adjacent precast building panels, the method comprising:

casting elongated hollow dowel members at the edges of at least two precast building panels, such that the dowel members are aligned perpendicularly to, and are open to, a side edge of the building panels, wherein the dowel members each include a longitudinal resting channel and a parallel access opening that opens along the length of the dowel member to an upper or front face of the respective panels;

positioning the precast building panels adjacent each other so as to co-linearly align dowel members in the adjacent panels;

inserting a dowel piece through the access openings of the co-linearly aligned dowel members and into a recess formed by the resting channels of the co-linearly aligned dowel members such that the dowel piece extends across both building panels; and filling the recess of the dowel members with a cementitious filler that once dry hardens to structurally join the adjacent building panels.

9. The method of joining adjacent precast building panels claimed in claim 8, including inserting the dowel piece into the recess by dropping the dowel piece through the access opening and into an access slot in each of the dowel members, wherein the access slot communicates with the resting channel in which the dowel piece settles.

10. The method of joining adjacent precast building panels claimed in claim 9, including casting the dowel members such that after positioning the building panels adjacently the resting channel is located lower than the access slot.

11. The method of joining adjacent building panels claimed in claim 8, further comprising:

fabricating each precast panel substantially from concrete including a first set of parallel conduits cast into the panel and extending through the panel to open to opposite sides of the panel; and after the precast building panels are adjacently positioned so that the conduit openings are co-linearly aligned, inserting tensioning cables through the co-linearly aligned conduits and tensioning the precast panels in the direction of the conduits to form a reinforced floor structure or wall structure.

12. The method claimed in claim 11, including installing a second set of parallel conduits extending through each panel substantially orthogonally to the first set of conduits and opening to second opposite sides, and inserting tensioning cables through the second conduits and tensioning the precast panel in the direction of the second conduits.

13. The method claimed in claim 11, including forming conduit recesses at one or both sides to where the conduits open.

14. The method claimed in claim 11, including grouting a recess at the conduit opening to anchor the cable into the floor or wall structure.

15. The method claimed in claim 11, including using a concrete slurry containing metal fibre to fabricate the precast panel.

16. The method claimed in claim 11, including fabricating a precast corner wall panel comprising perpendicular side panels with cast-in horizontal conduits extending through each side panel; erecting the corner wall panel on site to form a corner wall of a building; inserting cables through the conduits, applying tension to the cables and anchoring the tensioned cables to reinforce the corner wall.

17. The method claimed in claim 11, including fabricating the precast panel upside down on a bed comprising a steel plate and a perimeter frame; providing formwork for recesses; placing the set of parallel post-tensioning conduits on the bed to follow a pre-calculated wave profile; pouring concrete slurry onto the bed and, when dry, lifting and turning the bed right side up; and releasing the precast panel from the bed.

18. The method claimed in claim 11, wherein before casting in concrete the conduits are arranged to follow a pre-calculated wave profile.

* * * * *